US008292210B2

(12) United States Patent
Danielsson et al.

(10) Patent No.: US 8,292,210 B2
(45) Date of Patent: Oct. 23, 2012

(54) WINDING APPARATUS AND A METHOD OF WINDING

(75) Inventors: Hans-Erik Danielsson, Ludvika (SE); Rolf Häger, Ludvika (SE)

(73) Assignee: ABB Technology Ltd., Zürich (CH)

( * ) Notice: Subject to any disclaimer, the term of this patent is extended or adjusted under 35 U.S.C. 154(b) by 369 days.

(21) Appl. No.: 12/377,670

(22) PCT Filed: Aug. 14, 2007

(86) PCT No.: PCT/SE2007/050551

§ 371 (c)(1),
(2), (4) Date: Jun. 7, 2010

(87) PCT Pub. No.: WO2008/020807

PCT Pub. Date: Feb. 21, 2008

(65) Prior Publication Data

US 2010/0243786 A1 Sep. 30, 2010

(30) Foreign Application Priority Data

Aug. 14, 2006 (SE) ..... 0601676

(51) Int. Cl.
*B21C 47/14* (2006.01)

(52) U.S. Cl. ..... 242/439.6; 242/440.1; 242/441; 242/441.2

(58) Field of Classification Search ..... 242/437, 242/438, 438.1, 439, 439.5, 439.6, 440.1, 242/441, 441.2

See application file for complete search history.

(56) References Cited

U.S. PATENT DOCUMENTS

| | | | | |
|---|---|---|---|---|
| 2,070,925 | A * | 2/1937 | Rolfs et al. | 242/439.5 |
| 2,160,589 | A | 5/1939 | Granfield | |
| 2,657,866 | A * | 11/1953 | Lungstrom | 242/439.5 |
| 4,197,348 | A * | 4/1980 | Townsend | 428/377 |
| 4,346,550 | A * | 8/1982 | Ferree | 57/10 |
| 4,426,834 | A * | 1/1984 | Dokmo et al. | 242/441.3 |
| 4,448,015 | A * | 5/1984 | Usui | 242/441.3 |
| 4,529,138 | A | 7/1985 | Perschka | |
| 4,610,403 | A * | 9/1986 | Goekler et al. | 242/439.5 |
| 5,749,537 | A * | 5/1998 | Muzio et al. | 242/439.5 |
| 5,820,717 | A * | 10/1998 | Siegenthaler | 156/136 |
| 7,124,978 | B2 * | 10/2006 | Berger et al. | 242/439.5 |
| 7,905,442 | B2 * | 3/2011 | Uozumi et al. | 242/439.5 |

OTHER PUBLICATIONS

PCT/ISA/210—International Search Report—Nov. 12, 2007.
PCT/ISA/237—Written Opinion of the International Searching Authority—Nov. 12, 2007.

* cited by examiner

*Primary Examiner* — Emmanuel M Marcelo
(74) *Attorney, Agent, or Firm* — Venable LLP; Eric J. Franklin

(57) ABSTRACT

A winding apparatus for and a method of applying a winding of a band-like material to a limb of a transformer core. The winding apparatus includes a guide member arranged to be fixed in relation to the core limb and a rotary member carrying a supply of a band-like material.

13 Claims, 2 Drawing Sheets

WINDING APPARATUS AND A METHOD OF WINDING

CROSS-REFERENCE TO RELATED APPLICATIONS

This application claims priority to Swedish patent application 0601676-0 filed 14 Aug. 2006 and is the national phase under 35 U.S.C. §371 of PCT/SE2007/050551 filed 14 Aug. 2007.

FIELD OF THE INVENTION

The invention relates to an apparatus for and a method of applying a winding of a band-like material to a transformer core. The apparatus and method are especially useful for applying band-like windings to large transformer cores.

BACKGROUND

So-called power transformers and other large electrical transformers normally comprise a core having one or several core limbs and coils wound around each core limb. Except these basic transformer components large transformers normally comprise a number of comparatively thin materials wound around each core limb. Examples of such materials are paper, wool, insulating materials, semi-conducting materials and curable or thermosetting epoxy materials. In case of curable materials, these may be applied to the core limbs in a non-cured state and cured in a thermal treatment applied after that all different windings, including the coil have been applied to the core.

For ease of manufacturing and for other reasons such additional windings may be applied by winding a comparatively narrow tape- or band-like material around the core limbs. The axial length of the core limbs is much greater than the width of the tape-like material, such that a great number axially displaced or staggered turns are needed for applying one layer of the material covering the entire length of the core limb.

One example of such windings applied to transformer core limbs is the so-called asecond. The asecond is applied by winding a tape of a non-cured epoxy material onto the core limb. The asecond winding may be applied directly onto the core limb or onto an intermediate comparatively thin layer of paper or the like. Normally a few, such as two, layers of the asecond material are wound onto the core limb. After the asecond winding has been applied, other windings including the conducting coil are wound onto the core limb and the entire core and winding package is thereafter subject to a heat treatment, whereby the epoxy material of the asecond is cured.

According to the prior art, windings of band-like materials may be applied to transformer core limbs by fixing an end of the band contained on a spool to the core limb and thereafter rotating the core limb while displacing the spool in parallel with the axis of rotation of the core limb. Such methods comprising rotating the core limb may be automated and various apparatuses for carrying out such methods are known.

It is also known to apply a winding of a band-like material around a core limb, which core limb is kept stationary during the winding process. At such methods a spool or the like containing a supply of the band-like material is manually moved around the stationary core limb.

SUMMARY OF THE INVENTION

It is on object of the invention to provide an improved winding apparatus for and a method of applying a winding of a band-like material to a transformer core. It is a specific object to provide such a winding apparatus and method by means of which application of a winding of a band-like material to a large core may be automated.

The winding apparatus according to the invention comprises a guide member having a longitudinal axis, means for fixing the position of the guide member in relation to a core limb, a rotary member having an axis of rotation which is essentially parallel to the longitudinal axis of the guide member, which rotary member exhibits a through opening arranged to enclose a cross section of the core limb, means for attaching a supply of band-like material to the rotary member, and means for rotating the rotary member and for displacing the rotary member along the longitudinal axis of the guide member.

With the apparatus according to the invention it is possible to automatically apply a winding of a band- or tape-like material to a core limb while keeping the core limb stationary. This is a great advantage especially for large transformers such as power transformers, where each core limb typically has an axial length of 1-4 meters and a diameter of 0.5-1.5 meters. With the apparatus according to the invention the winding process may be fully automated without any need for rotation or other movement of the heavy and unwieldy core limb. Furthermore, the apparatus according to the invention allows automatic winding around each core limb of a multiple limb core also when the limbs are mounted to the core yokes.

The winding apparatus may comprise means for attaching several supplies of band-like material to the rotary member. Preferably two supplies of band-like material are attached to the rotary member. By this means the time needed for applying a desired amount of the band-like material may be reduced without increasing the rotational speed of the rotary member. This embodiment also allows application of two or more different band-like materials simultaneously.

The rotary member may comprise an annular member which comprises a first and a second section that are displaceable from each other for forming a radial opening in the annular member. By this means the rotary member may be arranged around the core limb without the need of passing the rotary member axially over an end of the core limb. This in turn allows applying a winding to a core limb, which is mounted between an upper and a lower yoke.

The means for attaching a supply of a band-like material to the rotary member may comprise a pin for fixing a roll of band-like material. By this means a spool or roll, which is easy to handle, attach and replace, may be used as the supply of the band-like material. The pin may be rotary in regard of the rotary member or it may be fixed. In the later case the roll will be rotary in regard of the pin. The rotation of the pin or roll may further be controlled, e.g. by means of a drive motor or a brake in order to control and achieve a desired tension in the band-like material.

The rotary member may be provided with means for collecting a cover strip from the band-like material. By this means, band-like materials having an adhesive side that, before winding, is covered by a cover strip may be readily applied to the core limb. Non-cured epoxy materials for forming an asecond on the core is an example of such band-like materials, which comprise a cover strip to be removed before winding onto the core.

The rotary member may be supported by a carriage, which in turn is supported by the guide member and displaceable in the longitudinal direction of the guide member. The rotation of the rotary member may be controlled by a first servomotor and the longitudinal movement of the carriage by a second servomotor. Control and coordination of the first and second servomotor may be achieved by a control means such as a digital processing device or the like. By this means a comparatively simple, flexible and reliable arrangement is achieved.

The invention also concerns a method of applying a winding of a band-like material to a limb of a transformer core. The method involves advantages corresponding to those of the winding apparatus.

Further features and advantages of the inventive apparatus and method will be apparent from the following detailed description and the appended claims.

BRIEF DESCRIPTION OF THE DRAWINGS

In the following an exemplifying embodiment of the invention will be given with reference to the drawings, in which.

DETAILED DESCRIPTION OF AN EMBODIMENT

In the figures, a winding apparatus according to the invention, for applying a winding of a band-like material to a transformer core limb is shown. The illustrated core limb 30 (FIG. 2) is one of several core limbs, which together with an upper and a lower yoke constitutes the core of a power transformer. The diameter of the core limb 30 is approx. 1.0 m and the height or length of the limb is approx. 3.0 m. It is understood however that an apparatus and a method according to the invention may also be used for applying windings to core limbs having other dimensions. The inventive apparatus and method are especially useful in combination with core limbs having diameters in the range of 0.5-1.5 meters and axial lengths in the range of 1-4 meters.

Figure 1:
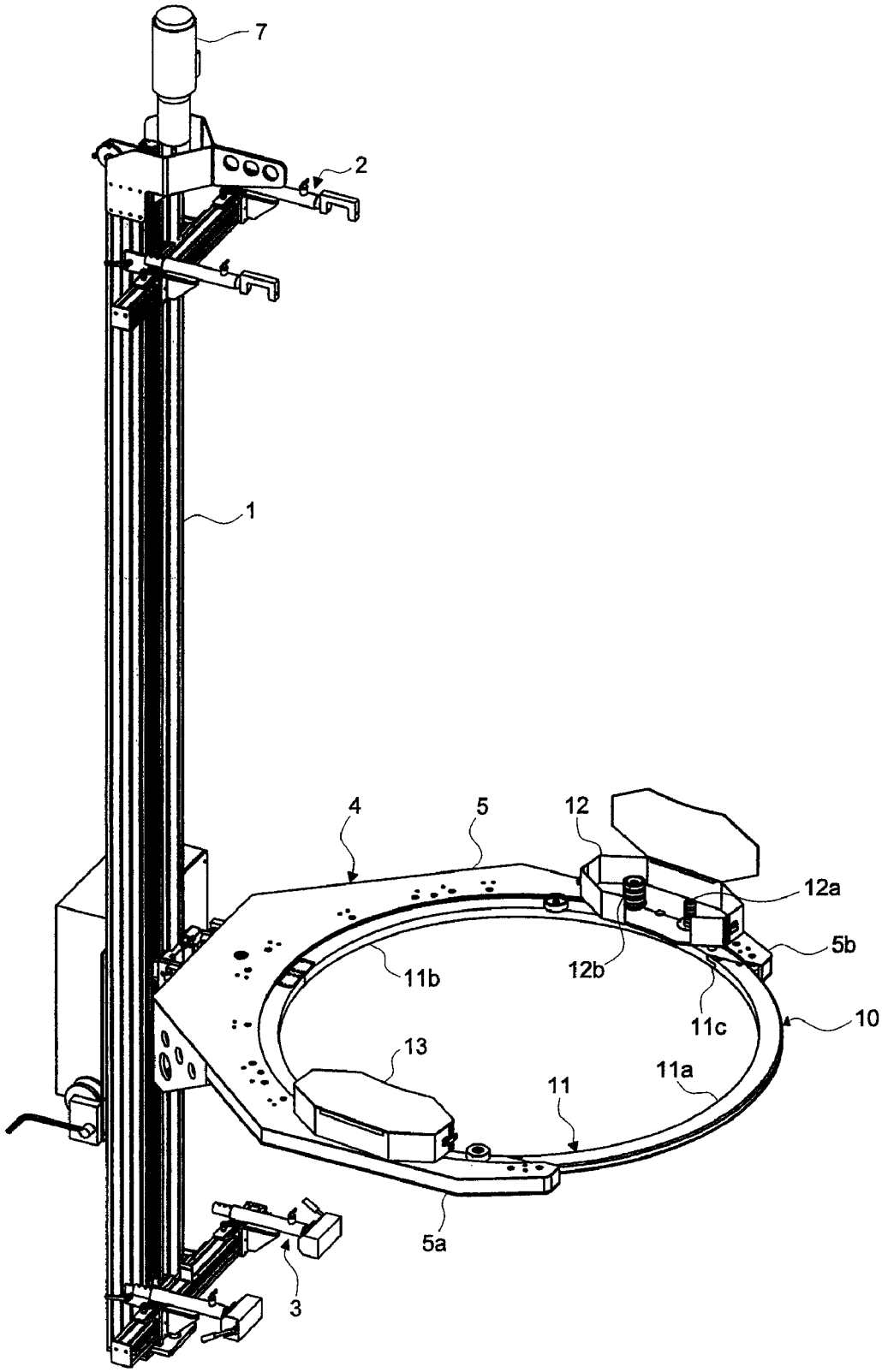
FIG. 1 is an isometric view of an embodiment of the winding apparatus according to the invention.
Figure 2:
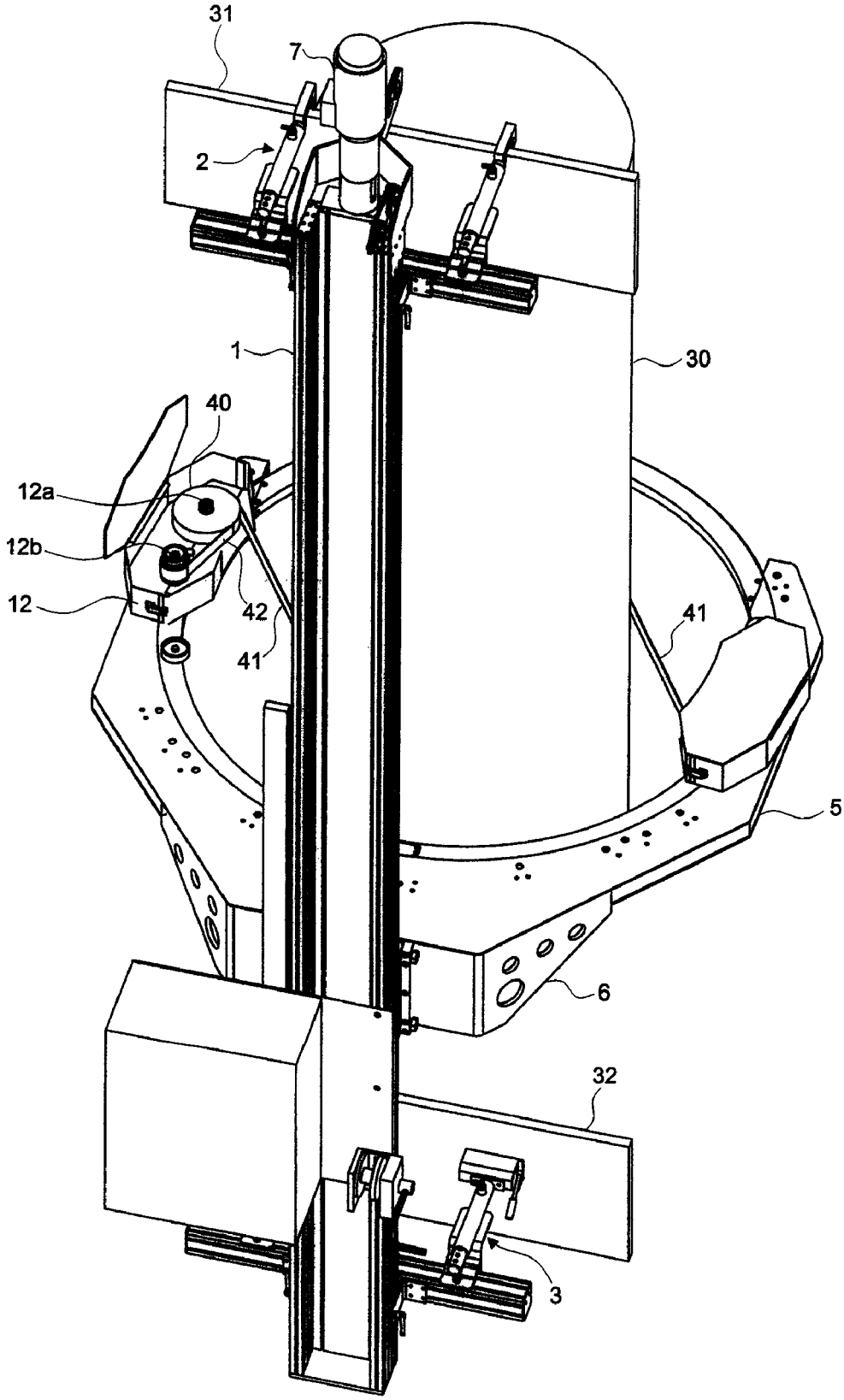
FIG. 2 is a schematic isometric view showing the apparatus of FIG. 1 in operation.

The winding apparatus shown in the figures comprises an elongated guide member 1. The guide member comprises a profile element of e.g. steel or aluminium, which may be formed by extrusion. Upper fixation means 2, in the form of a pair of adjustable hooks are arranged at the upper end of the guide member 1. Lower adjustable fixation means 3 are arranged at the lower end of the guide member 1. The upper 2 and lower 3 fixation means protrude transversely from the guide member 1 in order to allow fixation of the guide member 1 at a distance from and along a core limb 30 of a transformer core. In FIG. 2 it is schematically illustrated how the upper fixation means 2 is fixed to an upper clamping bar 31 for holding and clamping the core limb 30 during manufacturing of the transformer. The lower fixation means 3 is correspondingly fixed to a lower clamping bar 32. By this means the position of the guide member 1 is fixed in relation to the core limb 30. In this fixed position the guide member 1 is arranged essentially in parallel with the longitudinal axis of the cylindrical core limb 30 and at a transversal distance from the core limb.

The apparatus further comprises a carriage 4 which is longitudinally displaceable in relation to the guide member. For driving the carriage 4 along the guide member 1, the guide member comprises a longitudinally fixed elongated rotary screw (not shown) and the carriage 4 comprises a nut (not shown) which is threaded onto the screw. The screw may be driven for rotation in either direction by means of a servomotor 7 to thereby displace the nut and the carriage along the guide member. The carriage 4 comprises a flat generally U-shaped member 5 and a bracket 6, which comprises guide means for guiding the movement of the carriage 4 along the guide member 1. The shanks 5*a*, 5*b* of the U-shaped member 5 are directed away from the bracket 6 and the guide member 1, to thereby form a transversal opening into the U-shaped member 5.

The apparatus further comprises a rotary member 10 which is carried by the carriage 4. The rotary member is arranged for rotation relative to the carriage and around an axis, which is parallel to the longitudinal axis of the guide member 1. For this purpose the rotary member is rotary fixed to the carriage by means of bearings (not shown) arranged at the lower side of the U-shaped member 5. The rotary member 10 comprises an annular member 11 comprising first 11*a* and a second 11*b* section. The first 11*a* and second 11*b* sections are joined together at two dismountable connections 11*c*. The first 11*a* and second 11*b* sections forming the annular member 11 are made of a lightweight material such as plastic or aluminium. The rotation of the rotary member is driven by means of a servomotor (not shown). Both the servomotor 7 for displacing the carriage 4 and the motor for rotating the rotary member are controlled by a common control device, such as a digital processing device.

The rotary member 10 also comprises a first 12 and a second 13 housing which are fixed diametrically opposite to each other on the annular member 11. A first pin 12*a* for receiving a roll 40 carrying a band-like material 41 is arranged in each housing 12, 13. A second pin 12*b* for collecting a cover strip 42 from the band-like material is also arranged in each housing 12, 13. The first 12*a* and second 12*b* pins are arranged to rotate around respective axes, which are parallel to the rotational axis of the rotary member 10. The second pin 12 is driven for rotation such that in may collect the cover strip from the band-like material 41 when this is unwind from the roll 40. The rotation of the first pin 12*a* is braked such that an appropriate tension occurs in the band-like material 41 during application of the band-like material to the core limb 30. The rotation of the first pin 12*a* may also be controlled and driven for an increased tension control.

When a winding of a band-like material 41, such as a non-cured epoxy tape for forming an asecond, is to be applied to a core limb 30, the first section 11*a* of the annular member 11 is first separated from the second section 11*b*. The apparatus may then be moved transversely towards the core limb 30 such that a major portion of the core limb's cross-section is received within the U-shaped member. The position of the apparatus in relation to the core limb 30 is thereafter fixed by attaching the upper 2 and lower 3 fixation means to the upper 31 and lower 32 clamping bar. The first section 11*a* of the annular member 11 is then reattached to the second section 11*b*, such that the cross section of the core limb 30 is entirely encircled by the annular member 11.

A roll 40 of a band-like material 41 in the form of a non-cured epoxy tape is fixed to each first pin 12*a*. An end of each band-like material 41 is fixed at a starting position on the core limb 30 and an end of each cover strip 42 is fixed to the respective second pin 12*b*.

The common control means is thereafter activated to control the servomotors driving the rotation of the rotary member 10 and the displacement of the carriage such that the band-like material is wound onto the core limb in any desired manner. By adjusting the ratio between the speed of the axial displace-ment and the rotational speed of the rotary member the winding pattern may be controlled very accurately. Especially the pitch between consecutive winding turns may be accurately controlled. It is understood that the carriage may be displaced up and down repeatedly along the guide member to thereby produce windings of different thickness and number of layers.

When the desired winding has been applied to the core limb, the rotation of the rotary member 10 and the displacement of the carriage 4 are stopped. The annular member 11 is re-opened by separating the first section 11*a* from the second section 11*b* and the apparatus may thereafter be removed in a transversal direction away from the core limb.

Above an exemplifying description of the apparatus and the method according to the invention has been given. It is however understood that the invention is not limited to this description but in may be varied freely within the scope of the appended claims. For instance in the example given above the apparatus is fixed to upper and lower clamping bars. It is however also possible to fix the position of the guide member in relation to the core limb for instance by attaching the fixation means to the upper and lower core yokes or to any other structure which is fixed in relation to the core limb.

The invention claimed is:

1. A winding apparatus for applying a winding of a band of material to a limb of a transformer core, the winding apparatus comprising:

a guide member having a longitudinal axis, a fixing element configured to fix a position of the guide member in relation to the limb of the core, a rotary member having an axis of rotation which is essentially parallel to the longitudinal axis of the guide member, which rotary member comprising a through opening arranged to enclose a cross section of the core limb, an attaching element configured to attach a supply of the band of material to the rotary member, and a rotating element configured to rotate the rotary member, and a displacing member configured to displace the rotary member along the longitudinal axis of the guide member.

2. The winding apparatus according to claim 1, wherein the attaching element is configured to attach a first supply and a second supply of the band of material to the rotary member.

3. The winding apparatus according to claim 1, wherein the rotary member comprises an annular member comprising a first and a second section which first section is displaceable from the second section for forming a radial opening in the annular member.

4. The winding apparatus according to claim 1, wherein the supply of the band of material comprises a roll of the band of material, and wherein the attaching member configured to attach the supply of the band of material to the rotary member comprises a pin for fixing the roll of the band of material.

5. The winding apparatus according to claim 1, wherein the rotary member comprises a collecting element configured to collect a cover strip from the band of material.

6. The winding apparatus according to claim 1, wherein the rotary member is supported by a carriage which is supported by the guide member and displaceable in the longitudinal direction of the guide member.

7. The winding apparatus according to claim 6, wherein the rotation of the rotary member is controlled by a first servo motor and the longitudinal movement of the carriage is controlled by a second servo motor.

8. The winding apparatus according to claim 7, further comprising:

a control configured to control and coordinate the first and second servomotor.

9. A method of applying a winding of a band of material to a limb of a transformer core, the method comprising:

fixing a guide element of a winding apparatus in a fixed position in relation to the core limb, arranging a rotary member of the winding apparatus around the core limb, attaching a first supply of the band of material to the rotary member, fixing an end of the band of material contained in the supply to the core limb, and rotating the rotary member around the core limb and displacing the rotary member along its axis of rotation, while keeping the core limb stationary.

10. The method according to claim 9, further comprising:

attaching a second supply of a the band of material to the rotary member and fixing an end of the band of material contained in the second supply to the core limb.

11. The method according to claim 9, wherein the rotary member of the winding machine comprises at least one first section and at least one second section which first and second sections together form an annular member and wherein the step of arranging the rotary member around the core limb comprises forming a radial opening in the annular member by displacing the first section from the second section, moving the annular member radially towards the core limb such that the core limb is introduced through said opening and closing the opening by repositioning the first section at the second section such that the core is encircled by the annular member.

12. The method according to claim 9, further comprising:

collecting a cover strip from the band of material at a collector arranged on the rotary member.

13. The method according to claim 9, wherein the band of material comprises a non-cured epoxy material for forming an asecond on a transformer core limb.

* * * * *